US007721654B2

(12) United States Patent
Ueda

(10) Patent No.: US 7,721,654 B2
(45) Date of Patent: May 25, 2010

(54) STACKER CRANE

(75) Inventor: Yuichi Ueda, Kasugai (JP)

(73) Assignee: Daifuki Co., Ltd., Osaka (JP)

( * ) Notice: Subject to any disclaimer, the term of this patent is extended or adjusted under 35 U.S.C. 154(b) by 471 days.

(21) Appl. No.: 11/213,310

(22) Filed: Aug. 26, 2005

(65) Prior Publication Data

US 2006/0102433 A1 May 18, 2006

(30) Foreign Application Priority Data

Sep. 9, 2004 (JP) ..... 2004-262335

(51) Int. Cl.
*E01B 25/22* (2006.01)

(52) U.S. Cl. ..... 104/106; 414/279; 414/281

(58) Field of Classification Search ..... 414/460, 414/279, 281, 282, 623, 643; 105/148, 149, 105/150; 104/89, 91, 94, 106, 107
See application file for complete search history.

(56) References Cited

U.S. PATENT DOCUMENTS

| | | | | |
|---|---|---|---|---|
| 357,649 | A * | 2/1887 | Wright et al. | 105/29.1 |
| 3,519,150 | A * | 7/1970 | Keenan et al. | 414/273 |
| 3,866,767 | A * | 2/1975 | Zollinger et al. | 414/279 |
| 3,880,299 | A * | 4/1975 | Zollinger et al. | 414/273 |
| 4,217,530 | A * | 8/1980 | Dahm | 318/623 |
| 5,056,625 | A * | 10/1991 | Miskin et al. | 187/235 |
| 5,114,295 | A * | 5/1992 | Jansson | 414/460 |
| 5,238,348 | A * | 8/1993 | Reimer | 414/254 |
| 5,395,200 | A * | 3/1995 | Meier | 414/281 |
| 5,450,929 | A * | 9/1995 | Ohgita et al. | 187/244 |
| 6,602,038 | B2 * | 8/2003 | Ahn et al. | 414/279 |
| 2005/0053450 | A1 * | 3/2005 | Kantola et al. | 414/273 |

FOREIGN PATENT DOCUMENTS

| | | |
|---|---|---|
| JP | 49-007817 | 2/1974 |
| JP | 54-055944 | 5/1979 |
| JP | 59-007602 | 1/1984 |
| JP | 63-127910 | 5/1988 |
| JP | 63-218405 | 9/1988 |

(Continued)

*Primary Examiner*—Saúl J Rodríguez
*Assistant Examiner*—Joshua I Rudawitz
(74) *Attorney, Agent, or Firm*—The Webb Law Firm

(57) ABSTRACT

The invention provides a stacker crane, configured to move on a single rail provided along one or more racks, includes: a first wheel that moves on the rail; a second wheel that moves on the rail, and that is disposed spaced apart from the first wheel in a fore-and-aft direction; a vehicle frame supported by the first wheel and the second wheel; first drive supported by the vehicle frame for driving the first wheel. The vehicle frame includes: a first support frame for supporting the first wheel and the first drive means; a second support frame for supporting the second wheel; and a connection frame that connects the first support frame and the second support frame. The stacker crane also includes a first support post that extends vertically and whose lower end portion is connected to the first support frame; a second support post that extends vertically and whose lower end portion is connected to the second support frame; and a vertically movable platform that is guided by the first support post and the second support post, and that can move vertically with respect to the vehicle frame.

22 Claims, 7 Drawing Sheets

FOREIGN PATENT DOCUMENTS

| | | | | |
|---|---|---|---|---|
| JP | 05-162818 | | | 6/1993 |
| JP | 10-120112 | A | | 5/1998 |
| JP | 2000-044016 | A | | 2/2000 |
| JP | 2001-019119 | | | 1/2001 |
| JP | 2002046809 | A | * | 2/2002 |
| JP | 2003-002411 | A | | 1/2003 |
| JP | 2003212308 | | | 7/2003 |
| JP | 2003-237909 | A | | 8/2003 |

* cited by examiner

STACKER CRANE

BACKGROUND OF THE INVENTION

The present invention relates to stacker cranes.

Stacker cranes transport articles by moving a travel vehicle along a travel rail and raising and lowering a vertically movable platform on which an article is placed. In conventional configurations, the travel vehicle is constructed by connecting the lower end portions of a pair of front and rear support posts via a connection frame, and connecting a support frame that supports wheels and drive means to each of the front face of the front-side support post and the rear face of the rear-side support post, so that the lower end portions of the support posts are connected by and supported on the connecting frame and the support frames (see JP 2003-212308A, for example).

When the stacker crane is long in the fore-and-aft direction, the range over which it moves becomes wide, and thus although it is preferable for the stacker crane to have a short fore-and-aft length, it was not possible to narrow the gap between the pair of front and rear support posts more than a set spacing that corresponds to the width of the spacing between storage racks to which articles are transferred. Accordingly, in order to shorten the fore-and-aft length of the stacker crane, it is possible for the lower ends of the support posts to be connected by and supported on the forward end portion or the rear end portion of the travel vehicle so as to shorten the fore-and-aft length of the travel vehicle. In the conventional configuration described above, however, the support frames are connected to the front face of the front support frame and to the rear face of the rear support frame, and the support frames and all of the drive means and travel wheels supported on the support frames are positioned either in front of or behind the support posts. This causes the front end portion and the rear end portion of the travel vehicle to project significantly outward from the positions where the support posts are supported and thus increases the fore-and-aft length of the travel vehicle and makes it difficult to shorten the fore-and-aft length of the stacker crane.

SUMMARY OF THE INVENTION

The present invention was arrived at in view of the above circumstances, and it is an object thereof to provide a stacker crane whose length in the fore-and-aft direction can be shortened with ease.

A stacker crane according to the present invention is configured to move on a single rail provided along one or more racks, and comprises: a first wheel that moves on the rail; a second wheel that moves on the rail, and that is disposed spaced apart from the first wheel in a fore-and-aft direction; a vehicle frame supported by the first wheel and the second wheel; first drive means supported by the vehicle frame for driving the first wheel. The vehicle frame comprises: a first support frame for supporting the first wheel and the first drive means; a second support frame for supporting the second wheel; and a connection frame that connects the first support frame and the second support frame. The stacker crane also includes a first support post that extends vertically and whose lower end portion is connected to the first support frame; a second support post that extends vertically and whose lower end portion is connected to the second support frame; and a vertically movable platform that is guided by the first support post and the second support post, and that can move vertically with respect to the vehicle frame.

Since the support posts are arranged on support frames that support, at a minimum, the wheels, it is possible to provide a design that has the potential to allow the length of the stacker crane in the fore-and-aft direction to be shortened.

DETAILED DESCRIPTION OF THE PREFERRED EMBODIMENTS

Hereinafter, embodiments of a stacker crane according to the present invention are described with reference to the drawings. Throughout the specification the term "fore-and-aft direction" is used to indicate the orientation along which the stacker crane A moves.

Figure 1:
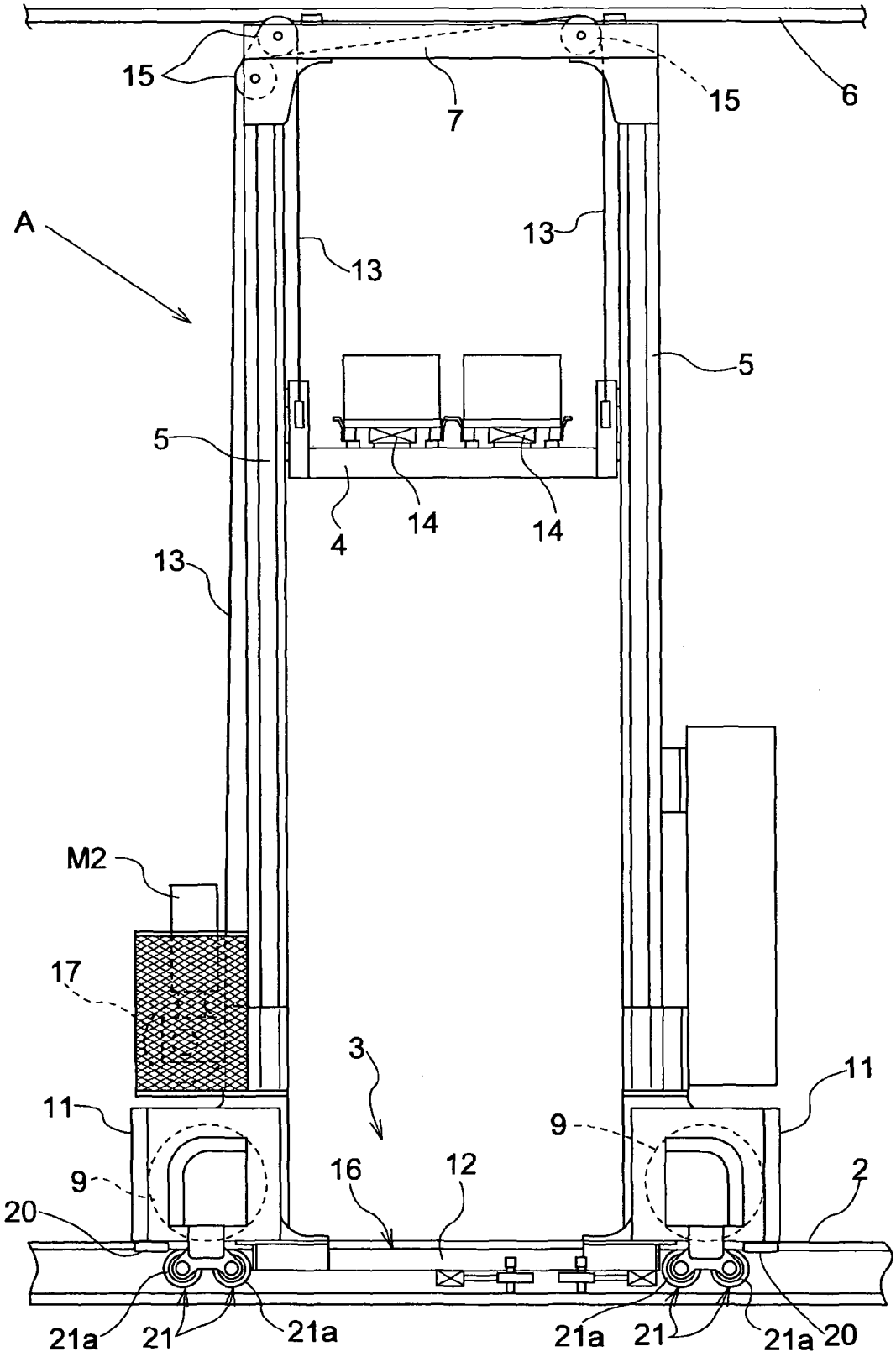
FIG. 1 is a lateral view of a stacker crane.

As shown in FIG. 1, a stacker crane A travels over a single travel rail 2 disposed on a floor surface along a work path formed between storage racks. A travel vehicle 3 that travels along the travel rail 2 is provided with a pair of support posts 5, with a spacing between them in the longitudinal or the fore-and-aft direction, that serve as guides for raising and lowering a vertically movable platform 4. The upper end portions of the support posts 5 are linked to each other by an upper frame 7 that is guided along a guide rail 6 disposed above the work path. The stacker crane A automatically moves over the work path and transfers articles to and from the storage racks. The stacker crane A and the storage racks together make up an automated warehouse.

A raising and lowering wire 13 is connected to the front and rear end portions of the vertically movable platform 4, supporting the vertically movable platform 4 in a suspended manner. Two article transferring devices 14 are arranged side by side in the front-to-back direction, that is, the direction in which the travel vehicle 3 moves, on the vertically movable platform 4, and the article transferring devices 14 transfer articles between the storage racks and the stacker crane A.

As for the raising and lowering wire 13, one of its ends is connected to the vertically movable platform 4, its middle portion is wound over driven pulleys 15 that are provided on the upper frame 7, and its other end is connected to a winding drum 17 that is supported on one of the pair of front and rear support posts 5. Accordingly, the vertically movable platform 4 is drivingly raised and lowered through the action of winding out or winding in the raising and lowering wire 13 by rotatively driving the winding drum 17 forward and in reverse with an electric motor for raising and lowering M2.

Figure 2:
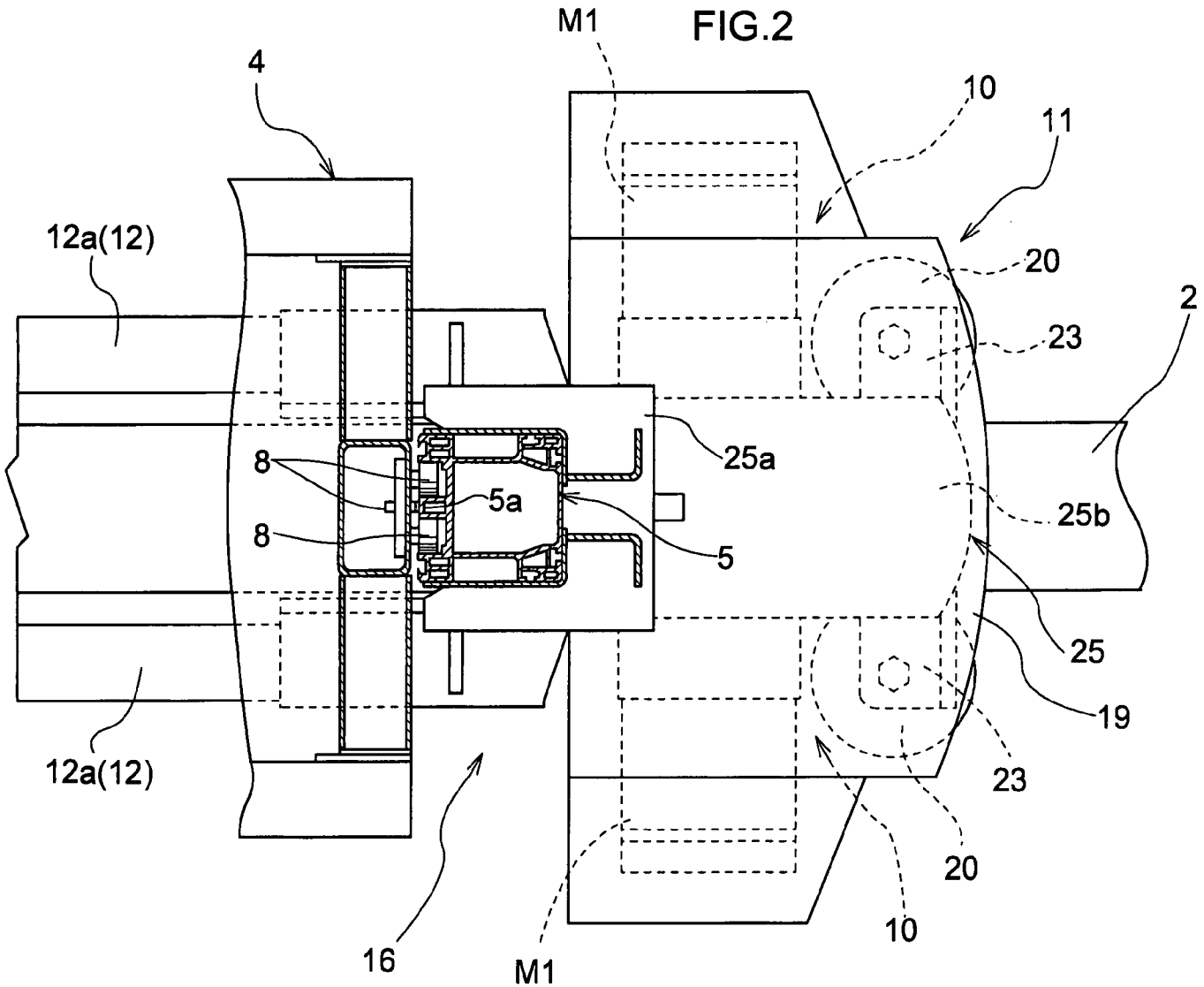
FIG. 2 is a cross-sectional view of a support post.

As shown in FIG. 2, the support posts 5 serve as guides for guide rollers 8 (guided portions) provided on the vertically movable platform 4. A recessed portion is provided in the longitudinal direction in one face of each of the support posts 5, and a projecting portion 5*a* (guide portion) is provided within the recessed portion. The configuration is such that the guide rollers 8 are guided by the projecting portion 5*a*, thereby guiding the vertically movable platform 4 along the raising and lowering path.

As shown in FIG. 2, three guide rollers 8 that abut against the top surface and the two side faces of the projecting portion 5*a*, respectively, are provided at the front end portion and at the rear end portion of the vertically movable platform 4. When drivingly raising or lowering the vertically movable platform 4 by the electric motor for raising and lowering M2 rotatively driving the winding drum 17 in the forward or reverse direction, the vertically movable platform 4 is guidingly raised or lowered while movement thereof in the fore-and-aft and lateral directions on the support post 5 is restricted by the guide rollers 8 abutting against the projecting portion 5*a*, and thus the vertically movable platform 4 is raised and lowered along the raising and lowering path.

The travel vehicle 3 is described next.

Figure 3:
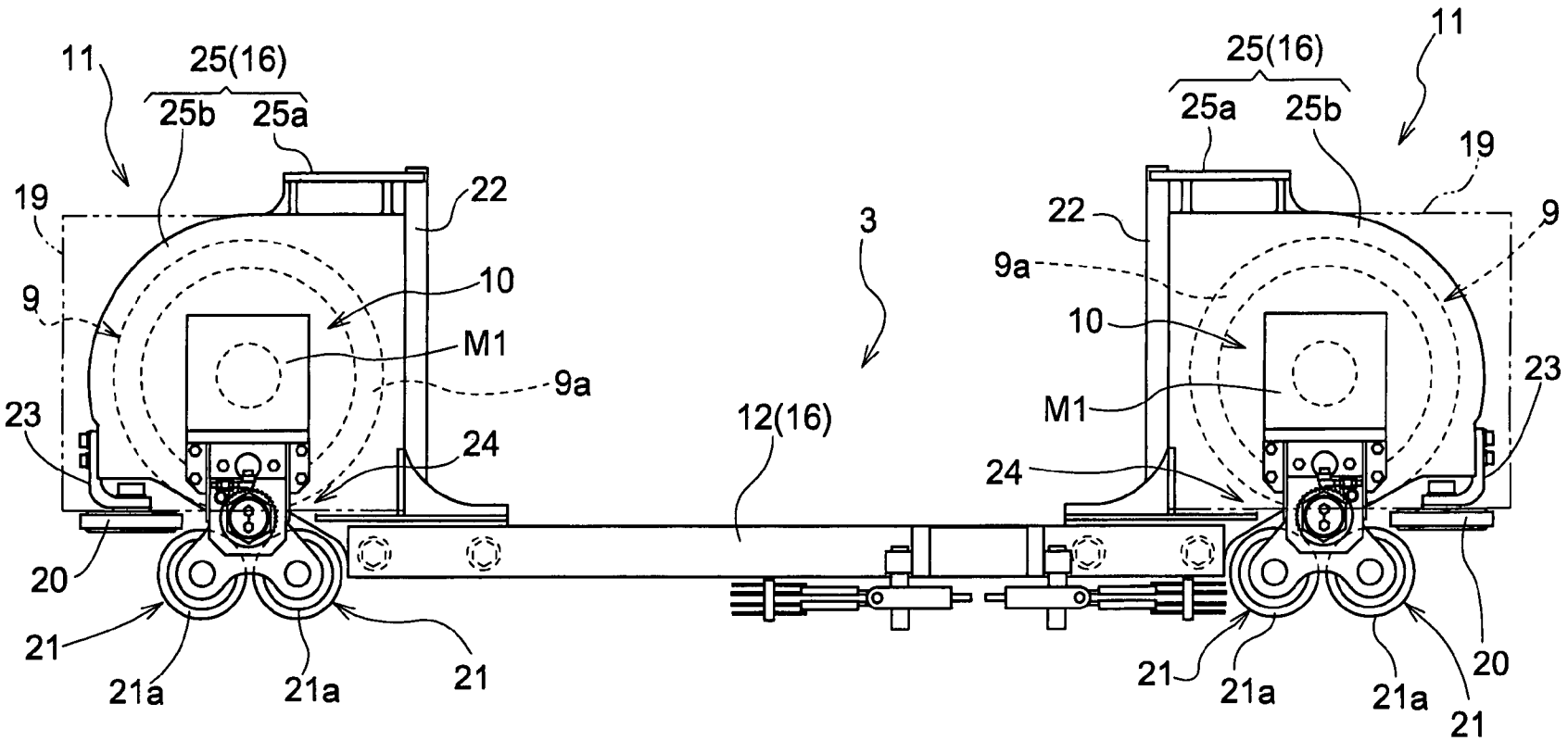
FIG. 3 is a lateral view of a travel vehicle.

As shown in FIG. 3, the travel vehicle 3 is provided with a pair of travel wheels 9, disposed with a spacing therebetween in the fore-and-aft direction, that are rotatively driven by drive means 10 and travel along the travel rail 2. The drive means 10 is fixedly supported on a vehicle frame 16 in the travel vehicle 3, and the travel wheels 9 are rotatably supported at the front end portion and the rear end portion of the vehicle frame 16. The drive means 10 is provided for each the travel wheel 9.

Figure 5:
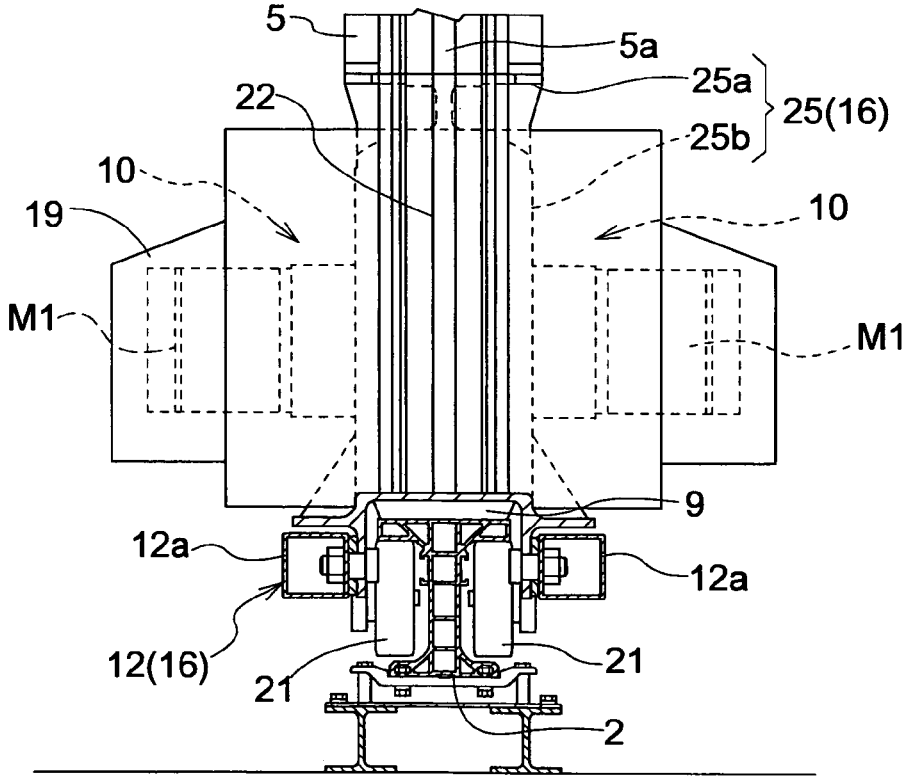
FIG. 5 is a front view of the travel drive unit.

As shown in FIG. 5, the travel wheels 9 are rotatably supported to the left and right of the center of the vehicle frame 16, and the drive means 10 is provided with a pair of left and right travel motors M1 supported on the vehicle frame 16 and located to the right and the left of the travel wheels 9. The right and left travel motors M1 are configured so as to rotatively drive one travel wheel 9 each, and thus the two front and rear travel wheels 9 are rotatively driven by a total of four travel motors M1.

As shown in FIGS. 2 and 5, the vehicle frame 16 is configured by connecting a pair of front and rear support frames 25 that support the travel wheels 9 and the drive means 10, via a connection frame 12. The connection frame 12 is constituted by right and left frame members 12*a* located on the respective side of the travel rail 2.

Each support frame 25 is configured such that the travel wheels 9 are rotatably supported to the left and right of center, the travel motors M1 are fixedly supported on the right and left side portions, and the lower end portion of the support post 5 is connected to supported by the upper end portion. The travel wheel 9 and the drive means 10 are incorporated into a single unit with the support frame 25, thereby forming a travel drive unit 11.

The travel drive units 11 are described next.

As shown in FIGS. 4 to 7, in addition to the travel wheel 9, the drive means 10, and the support frame 25, each travel drive unit 11 is provided with a unit cover 19 that covers the drive means 10, a pair of guide wheels 20 that are in contact with the travel rail 2 in order to restrict lateral movement of the stacker crane A with respect to the travel rail 2 and that guide the stacker crane A along the travel rail 2, restriction wheels 21 that are in contact with the travel rail 2 so as to restrict upward movement and thereby restrict upward floating of the travel wheel 9 from the travel rail 2, and a servo-type adjustment means 24 for adjusting the contact pressure of the restriction wheels 21 against the travel rail 2 by raising or lowering the restriction wheels 21.

An annular travel tire portion 9*a*, which is an elastic member made of urethane rubber, is attached to the outer circumferential portion of the travel wheel 9, and restriction tire portions 21*a*, which are annular elastic members made of urethane rubber, are attached to the outer circumferential portion of the restriction wheels 21.

In other words, the configuration is such that lateral movement of the stacker crane A with respect to the travel rail 2 is restricted by the guide wheels 20 abutting against the side faces of the travel rail 2, so that the stacker crane A is moved over and along the travel rail 2 by rotatively driving the travel wheels 9 with the drive means 10 so that the travel wheels 9 travel over the upper face of the travel rail 2, which has a T-shaped cross-sectional shape when viewed in the fore-and-aft direction. Further, the travel wheels 9 are kept from floating upward from the travel rail 2 by the restriction wheels 21 abutting against the lower face of the travel rail 2, keeping the travel wheels 9 from floating upward when the stacker crane A is accelerated or decelerated and thereby preventing the travel wheels 9 from slipping.

As shown in FIG. 5, an extension guide rail 22 for guiding the guide rollers 8 of the vertically movable platform 4 upward and downward is provided on the support frames 25 in such a manner that it is continuous with the projecting portion 5*a* of the support post 5. These allow the raising and the lowering platform 4 to be lowered close to the lower end of the stacker crane A.

Figure 6:
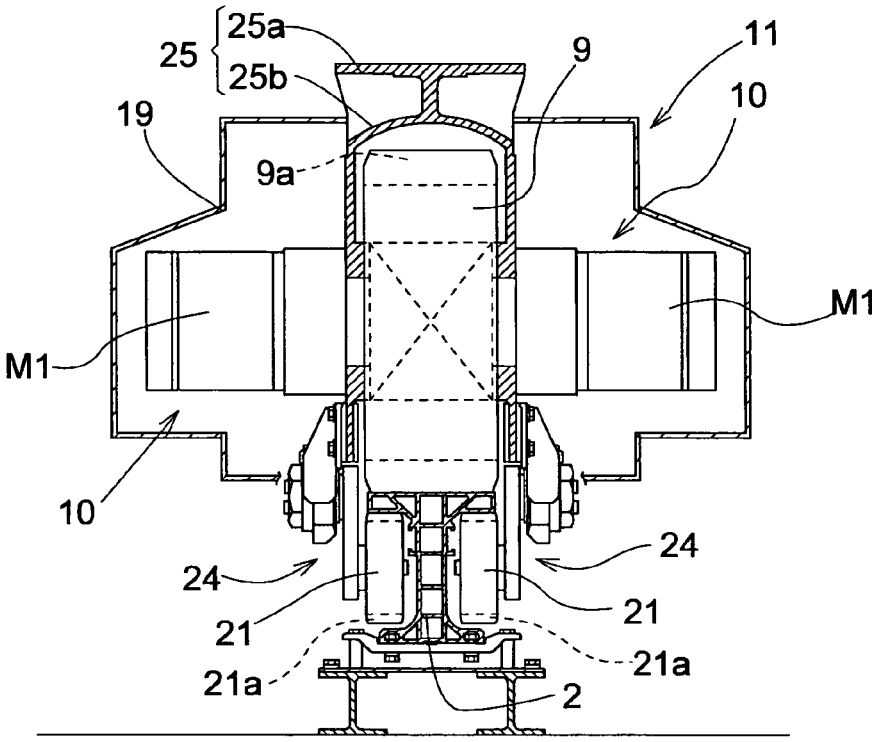
FIG. 6 is a front cross-sectional view of the travel drive unit.

As shown in FIG. 6, the travel wheels 9 are supported in such a manner that they can rotate about an axis in the horizontal direction with respect to the support frame 25. The drive means 10 are supported on the support frame 25 in such a manner that they are located on either side of the travel wheels 9. The drive means 10 are configured such that the travel motors M1 are fixedly supported on the right side and the left side portion of the support frame 25, the right and left travel motors M1 together rotatively driving one travel wheel 9. It should be noted that the drive means 10 each are provided with a braking mechanism, which is not shown because it is conventional art, in addition to the travel motors M1. The drive means 10 can also include a deceleration gear mechanism.

Figure 4:
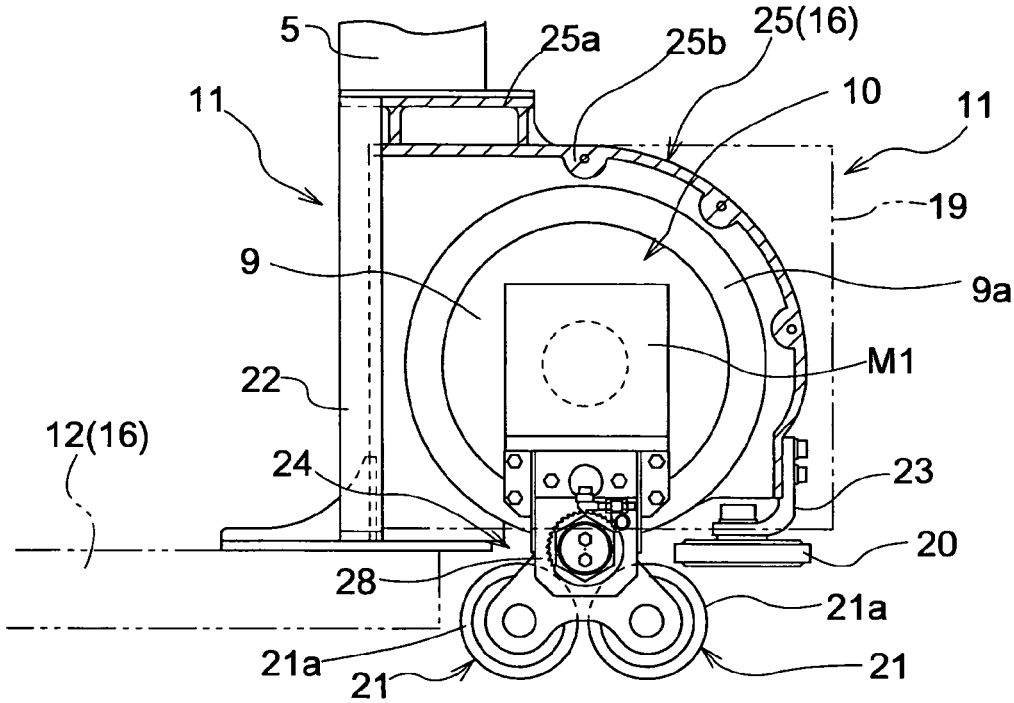
FIG. 4 is a lateral view of a travel drive unit.

Describing the support frame 25 more specifically, as shown in FIGS. 4 and 6, the support frame 25 includes a support platform portion 25*a* for supporting the lower end portion of the support post 5, and right and left support portions 25*b* that are positioned below the support platform portion 25*a* and that are for supporting the travel wheels 9 and the drive means 10.

The lower end of the support post 5 is connected to the support platform portion 25*a* through a flange provided at the lower end of the support post 5 and nuts and bolts, and the support post 5 is supported such that the lower end of the support post 5 is positioned above the upper end of the travel wheels 9 and the upper end of the drive means 10.

Furthermore, the travel wheel 9 is supported between the right support portion 25*b* and the left support portion 25*b* in such a manner that it can rotate about an axis in the horizontal direction. The travel motors M1 are fixedly supported to the outer face side of the right support portion 25*b* and the left support portion 25*b*, and each travel motor M1 is provided on the support frame 25 so that the drive shaft of the travel motor M1 rotates about the same axis as the travel wheel 9.

Figure 7:
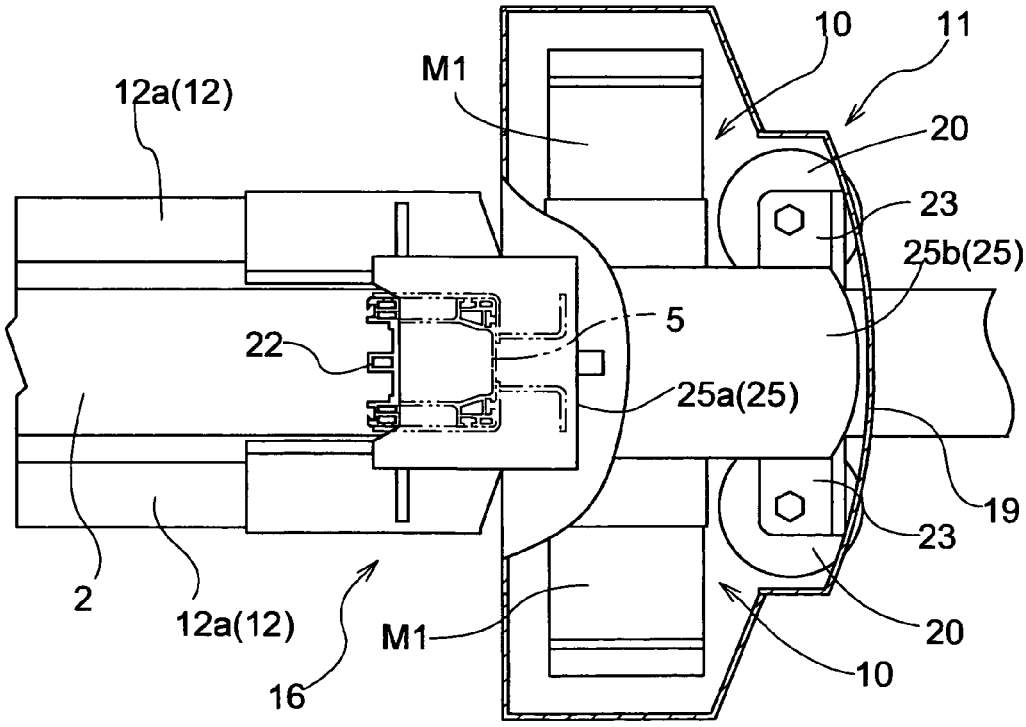
FIG. 7 is a plan cross-sectional view of the travel drive unit.

As shown in FIGS. 4 and 7, the frame members 12*a* are connected to the rear end portions of the left and right support portions 25*b* of the front-side support frame 25 and to the front end portions of the left and right support portions 25*b* of the rear-side support frame 25, and thus the pair of front and rear support frames 25 are connected via the connection frame 12.

The guide wheels 20 are supported at the front end portions of the left and right support portions 25*b* of the front-side support frame 25 and at the rear end portions of the left and right support portions 25*b* of the rear-side support frame 25, in such a manner that they can rotate about a vertical axis via guide support members 23.

Further, the restriction wheels 21 are supported at a central portion in the front-to-back direction of the left and right support portions 25*b* of the front-side support frame 25 and at a central portion in the front-to-back direction of the left and right support portions 25*b* of the rear-side support frame 25, in such a manner that they can rotate about a horizontal axis via the adjustment means 24.

The restriction wheels 21 are supported by the support frames 25 in such a manner that they are in contact with the travel rail 2 with contact pressure that is due to the elasticity of the restriction tire portions 21*a*. The restriction wheels 21, being in contact with the lower face of the travel rail 2 with the contact pressure, keep the travel wheels 9 from floating upward from the travel rail 2. Each restriction wheel 21 is supported in such a manner that it can be raised and lowered with respect to the corresponding travel drive unit 11, and the contact pressure applied by the restriction wheels 21 to the travel rail 2 is adjusted by raising and lowering the restriction wheels 21 with the adjustment means 24 so as to elastically deform the restriction tire portions 21*a*.

Figure 8:
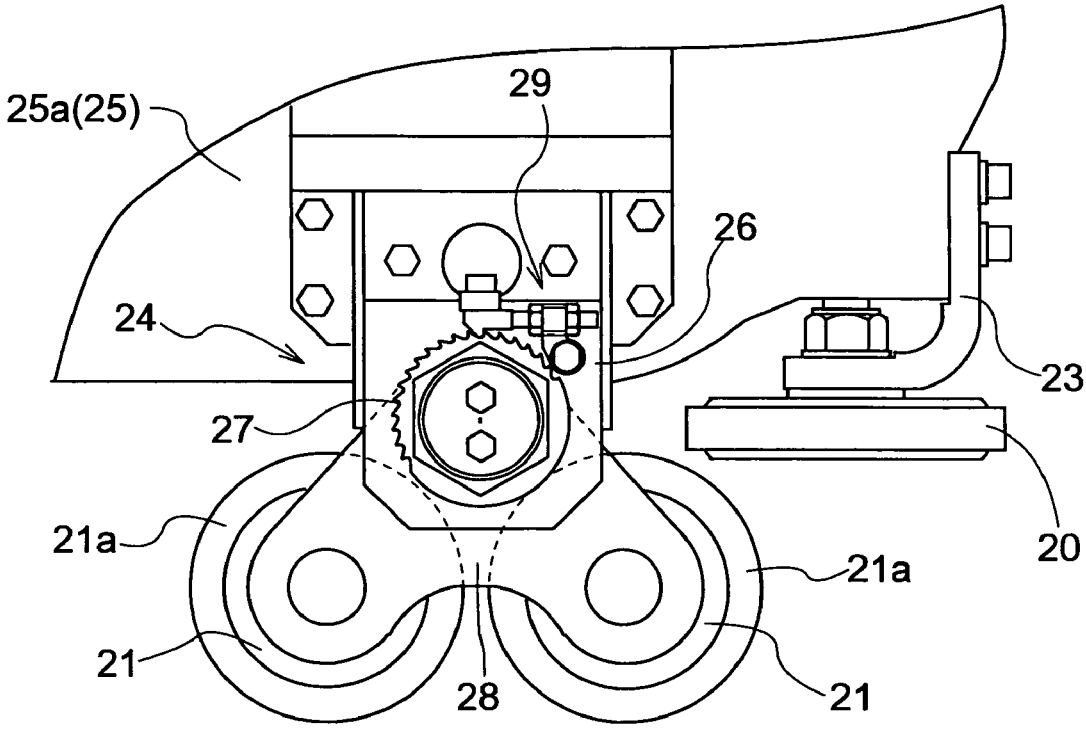
FIG. 8 is a lateral view of the adjustment means.
Figure 9:
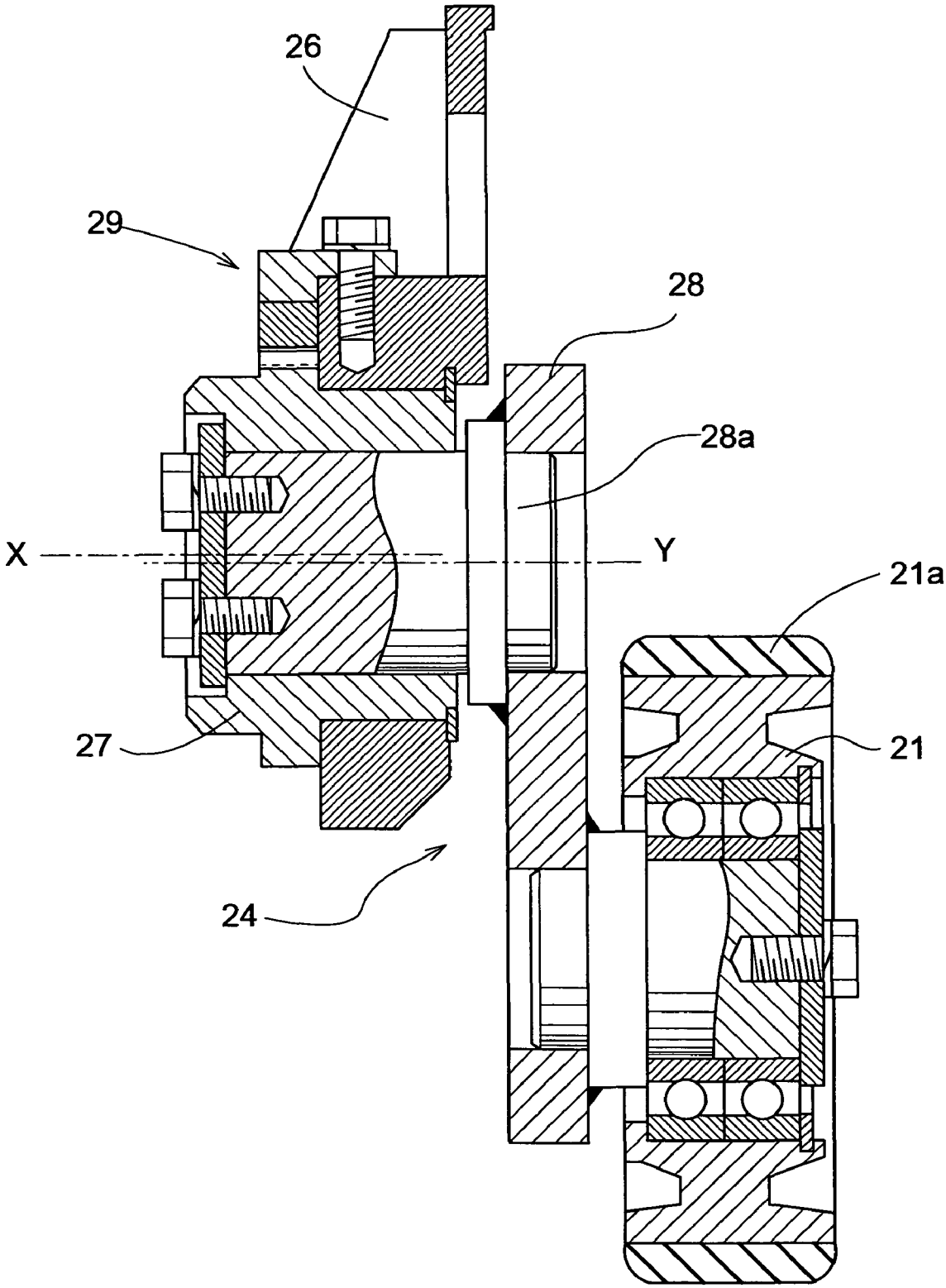
FIG. 9 is a front view of an adjustment mechanism.

Describing the adjustment means 24 more specifically, as shown in FIGS. 6, 8, and 9, the adjustment means 24 is a servo-type eccentric cam mechanism that is provided with an operation member 27 that is supported by a base holder 26, which is fixedly supported to the outer surface side of the right support portion 25*b* and the left support portion 25*b* of the support frame 25, in such a manner that it can freely rotate about a horizontal axis, and a support member 28 that rotatively supports the pair of front and rear restriction wheels 21 via bearings and that is fitted into and supported by the operation member 27 in such a manner that it can pivot deviated with respect to the rotation axis of the operation member 27. The adjustment means 24 is also provided with a lock mechanism 29 that can switch between a fastened state where rotation of the operation member 27 is locked and an unfastened state in which the lock on rotation is released.

As shown in FIG. 9, the configuration of the eccentric cam mechanism of the support member 28 is such that the shaft portion 28*a* of the support member 28 is supported by the operation member 27 in such a manner that its pivot axis Y is parallel to the rotation axis X of the operation member 27 but deviated from the rotation axis X, so that by rotatively actuating the shaft portion 28*a* about the rotation axis X, the shaft portion 28*a* rotates in a relative manner about the pivot axis Y due to its own weight and being abutted against the travel rail 2, causing the support member 28 to move along the rotation axis X while maintaining its orientation. As a result, the support member 28 is raised and lowered with respect to the travel drive unit 11. Also, by raising and lowering the support member 28 in this manner, the two restriction wheels 21 supported by the support member 28 are also raised and lowered with respect to the travel drive unit 11, causing the restriction tire portions 21*a* to be elastically deformed due to abutting against the lower surface of the travel rail 2 and therefore altering the contact pressure of the restriction wheels 21 with respect to the travel rail 2.

Other Embodiments (1) In the foregoing embodiment, the support frames are provided with an extension guide rail over which the guided portion of the vertically movable platform is guidingly raised and lowered, but it is also possible for the extension guide rail to not be provided. For example, it is also possible to adopt a configuration in which the guide portions of the support posts extend below the lower end portion of the main support post, and that this extension guide portion is connected to the support frame.

(2) In the foregoing embodiment, the drive means are supported on the support frames positioned to the side of the travel wheels, but the drive means may be supported on the support frames positioned on the front side portion and on the rear side portion of the travel wheels.

(3) In the foregoing embodiment, the travel wheels and the support posts are supported by the support frames so that the travel wheels and the support posts overlap vertically when viewed in the lateral direction and the fore-and-aft direction, but the travel wheels and the support posts may be supported by the support frames so that the travel wheels are shifted in the lateral direction or the fore-and-aft direction in such a manner that they do not vertically overlap the support posts when viewed in the lateral direction, the fore-and-aft direction, or both directions.

(4) In the foregoing embodiment, the restriction wheels 21 are supported by the support frames 25 in such a manner that they contact the travel rail 2 with contact pressure due to the elasticity of the elastic member 21*a*. However, it is also possible for the regulation wheels 21 to be supported by the support frames 25 in such a manner that they contact the travel rail 2 with contact pressure without providing the elastic member 21*a*.

What is claimed is:

1. A stacker crane configured to move on a single rail provided along one or more racks, the single rail having a top face, side faces, and a downward facing face, the stacker crane comprising:

a first wheel that moves on the rail;

a second wheel that moves on the rail, and that is disposed spaced apart from the first wheel in a fore-and-aft direction;

a vehicle frame supported by the first wheel and the second wheel;

first drive means supported by the vehicle frame for driving the first wheel;

wherein the vehicle frame comprises:

a first support frame for supporting the first wheel and the first drive means, the first support frame having a first upwardly facing surface;

a second support frame for supporting the second wheel, the second support frame having a second upwardly facing surface; and a connection frame connected to the first support frame and the second support frame such that at least a part of the connecting frame is located at a level below a point at which the first wheel contacts the top face of the rail and a point at which the second wheel contacts the rail;

a first support post that extends vertically and has a downwardly facing surface that is connected to the first upwardly facing surface of the first support frame;

a second support post that extends vertically and has a downwardly facing surface that is connected to the second upwardly facing surface of the second support frame, the first wheel and the first support post being supported by the first support frame such that the first wheel vertically overlaps with the first support post when viewed in a lateral direction and a fore-and-aft direction, the second wheel and the second support post being supported by the second support frame such that the second wheel vertically overlaps with the second support post when viewed in a lateral direction and a fore-and-aft direction;

a first restriction wheel rotatably supported by the first support frame such that the first restriction wheel is in contact with the downward facing face of the rail with elastic force from an elastic portion, and the first restriction wheel restricting lifting of the first wheel from the rail;

a third restriction wheel rotatably supported by the second support frame such that the third restriction wheel is in contact with the downward facing face of the rail with elastic force from an elastic portion, the third restriction wheel restricting lifting of the second wheel from the rail; and a vertically movable platform that is guided by the first support post and the second support post, and that can move vertically with respect to the vehicle frame wherein the connection frame comprises a right frame member positioned on a right side of the rail and a left frame member positioned on a left side of the rail, the right frame member is connected to a rear end portion of the right support portion of the first support frame and to a front end portion of a right support portion of the second support frame, and the left frame member is connected to a rear end portion of a left support portion of the first support frame and to a front end portion of a left support portion of the second support frame.

2. The stacker crane according to claim 1, wherein a guide portion that abuts against a guided portion provided in the vertically movable platform is formed on each of the first and the second support posts.

3. The stacker crane according to claim 1, wherein a first extension guide rail for guiding the guided portion of the vertically movable platform is provided below and continuous with the first support post.

4. The stacker crane according to claim 3, wherein a second extension guide rail for guiding the guided portion of the vertically movable platform is provided below and continuous with the second support post.

5. The stacker crane according to claim 1, further comprising:

second drive means supported by the second support frame for driving the second wheel.

6. The stacker crane according to claim 5, wherein the second drive means includes a second motor supported on the second support frame such that the second motor is positioned at a lateral side of the second wheel.

7. The stacker crane according to claim 1, wherein the first drive means includes a first motor supported on the first support frame such that the first motor is positioned at a lateral side of the first wheel.

8. The stacker crane according to claim 1, further comprising:

a second restriction wheel supported by and rotatable with respect to the first support frame, and the second restriction wheel working with the first restriction wheel to restrict lifting of the first wheel from the rail.

9. The stacker crane according to claim 8, further comprising:

adjustment means disposed between the first support frame, and the first restriction wheel and the second restriction wheel for adjusting the positions of the first restriction wheel and the second restriction wheel with respect to the vehicle frame.

10. The stacker crane according to claim 1, further comprising:

a fourth restriction wheel supported by and rotatable with respect to the second support frame, and the fourth restriction wheel working with the third restriction wheel to restrict lifting of the second wheel from the rail.

11. The stacker crane according to claim 10, further comprising:

adjustment means disposed between the second support frame, and the third restriction wheel and the fourth restriction wheel for adjusting the positions of the third restriction wheel and the fourth restriction wheel with respect to the vehicle frame.

12. The stacker crane according to claim 1, further comprising:

an upper frame that can engage a guide rail fixed to upper positions of the one or more racks, and that is fixed to an upper portion of each of the first and the second support posts.

13. The stacker crane according to claim 1, wherein the first support frame has a first support frame surface that faces the second support frame;

the second support frame has a second support frame surface that faces the first support frame;

the first support post has a first support post surface that faces away from the second support post;

the second support post has a second support post surface that faces away from the first support post;

the first support post is mounted to the first support frame such that the first support post surface is located farther away from the second support post in the fore-and-aft direction than the first support frame surface; and the second support post is mounted to the second support frame such that the second support post surface is located farther away from the first support post in the fore-and-aft direction than the second support frame surface.

14. The stacker crane according to claim 1, wherein the first support post has a guide portion that contacts a guided portion of the vertically movable platform, and wherein an entirety of the first support post other than the guide portion is mounted on the first upwardly facing surface of the first support frame.

15. The stacker crane according to claim 14, wherein the second support post has a guide portion that contacts a guided portion of the vertically movable platform, and wherein an entirety of the second support post other than the guide portion of the second support post is mounted on the second upwardly facing surface of the second support frame.

16. The stacker crane according to claim 1, wherein the connection frame is connected to the first support frame and the second support frame such that an upper surface of the connecting frame is located at a level below the lowest surface of the first wheel and the lowest surface of the second wheel.

17. A stacker crane configured to move on a single rail provided along one or more racks, the single rail having a top face, side faces, and a downward facing face, the stacker crane comprising:

a first wheel that moves on the rail;

a second wheel that moves on the rail, and that is disposed spaced apart from the first wheel in a fore-and-aft direction;

a vehicle frame supported by the first wheel and the second wheel;

a first motor that is supported by the vehicle frame, and that drives the first wheel;

a second motor that is supported by the vehicle frame, and that drives the second wheel;

wherein the vehicle frame comprises:

a first support frame that supports the first wheel and the first motor, the first support frame having a first upwardly facing surface;

a second support frame that supports the second wheel and the second motor, the second support frame having a second upwardly facing surface; and a connection frame connected to the first support frame and the second support frame such that at least a part of the connecting frame is located at a level below a point at which the first wheel contacts the top face of the rail and a point at which the second wheel contacts the top face of the rail;

a first support post that extends vertically and has a downwardly facing surface that is connected to the first upwardly facing surface of the first support frame;

a second support post that extends vertically and has a downwardly facing surface that is connected to the second upwardly facing surface of the second support frame, the first wheel and the first support post being supported by the first support frame such that the first wheel vertically overlaps with the first support post when viewed in a lateral direction and a fore-and-aft direction, the second wheel and the second support post being supported by the second support frame such that the second wheel vertically overlaps with the second support post when viewed in a lateral direction and a fore-and-aft direction;

a first restriction wheel rotatably supported by the first support frame such that the first restriction wheel is in contact with the downward facing face of the rail with elastic force from an elastic portion, and the first restriction wheel restricting lifting of the first wheel from the rail;

a third restriction wheel rotatably supported by the second support frame such that the third restriction wheel is in contact with the downward facing face of the rail with elastic force from an elastic portion, the third restriction wheel restricting lifting of the second wheel from the rail; and a vertically movable platform that is guided by the first support post and the second support post, and that can move vertically with respect to the vehicle frame, wherein the connection frame comprises a right frame member positioned on a right side of the rail and a left frame member positioned on a left side of the rail, the right frame member is connected to a rear end portion of the right support portion of the first support frame and to a front end portion of a right support portion of the second support frame, and the left frame member is connected to a rear end portion of a left support portion of the first support frame and to a front end portion of a left support portion of the second support frame.

18. The stacker crane according to claim 17, further comprising:

an upper frame that can engage a guide rail fixed to upper positions of the one or more of the racks, and that is fixed to an upper portion of each of the first and the second support posts.

19. The stacker crane according to claim 17, wherein the first support frame has a first support frame surface that faces the second support frame;

the second support frame has a second support frame surface that faces the first support frame;

the first support post has a first support post surface that faces away from the second support post;

the second support post has a second support post surface that faces away from the first support post;

the first support post is mounted to the first support frame such that the first support post surface is located farther away from the second support post in the fore-and-aft direction than the first support frame surface; and the second support post is mounted to the second support frame such that the second support post surface is located farther away from the first support post in the fore-and-aft direction than the second support frame surface.

20. The stacker crane according to claim 17, wherein the first support post has a guide portion that contacts a guided portion of the vertically movable platform, and wherein an entirety of the first support post other than the guide portion is mounted on the first upwardly facing surface of the first support frame.

21. The stacker crane according to claim 20, wherein the second support post has a guide portion that contacts a guided portion of the vertically movable platform, and wherein an entirety of the second support post other than the guide portion of the second support post is mounted on the second upwardly facing surface of the second support frame.

22. The stacker crane according to claim 17, wherein the connection frame is connected to the first support frame and the second support frame such that an upper surface of the connecting frame is located at a level below the lowest surface of the first wheel and the lowest surface of the second wheel.

* * * * *

UNITED STATES PATENT AND TRADEMARK OFFICE

CERTIFICATE OF CORRECTION

PATENT NO. : 7,721,654 B2
APPLICATION NO. : 11/213310
DATED : May 25, 2010
INVENTOR(S) : Ueda It is certified that error appears in the above-identified patent and that said Letters Patent is hereby corrected as shown below:

Face of the Patent, Item (73) Assignee:, "Daifuki Co., Ltd." should read
-- Daifuku Co., Ltd. --

Signed and Sealed this

Twenty-sixth Day of October, 2010

David J. Kappos

David J. Kappos
*Director of the United States Patent and Trademark Office*